US005282429A

United States Patent [19]

Kato et al.

[11] Patent Number: 5,282,429

[45] Date of Patent: Feb. 1, 1994

[54] METHOD AND SYSTEM FOR HANDLING EXHAUST GAS IN A BOILER

[75] Inventors: Masami Kato; Tadashi Tanaka; Yasuki Nishimura, all of Nagoya; Katsutoshi Yata; Masahiko Nakao, both of Kobe; Takeshi Sakai; Tsuyoshi Ohishi, both of Tokyo; Tsuneo Higashi, Mihara, all of Japan

[73] Assignees: Chubu Electric Power Company Inc., Aichi; Mitsubishi Jukogyo Kabushiki Kaisha, Tokyo, both of Japan

[21] Appl. No.: 897,083

[22] Filed: Jun. 11, 1992

Related U.S. Application Data

[63] Continuation-in-part of Ser. No. 653,231, Feb. 8, 1991, abandoned.

[51] Int. Cl.[5] ..... F23J 3/00

[52] U.S. Cl. ..... 110/344; 110/215; 110/216; 110/345; 110/245

[58] Field of Search ..... 110/215, 216, 245, 344, 110/345; 122/4 D

[56] References Cited

U.S. PATENT DOCUMENTS 4,509,437 4/1985 Breidenbach et al. .
4,757,772 7/1988 Lisowyj et al. .
4,898,105 2/1990 Rappoldt et al. .
4,958,578 9/1990 Houser .
4,987,839 1/1991 Krigmont et al. .
5,024,681 6/1991 Chang .
5,161,471 11/1992 Piekos ..... 110/245

*Primary Examiner*—Henry C. Yuen
*Attorney, Agent, or Firm*—Wenderoth, Lind & Ponack

[57] ABSTRACT

In a coal-fired boiler, a heat recovery unit is located upstream of a dry electrostatic precipitator so as to reduce the temperature of exhaust gas flowing to the dry electrostatic precipitator and thus prevent reverse ionization in the electrostatic precipitator. The heat recovery unit located upstream of the dry electrostatic precipitator will in no way be corroded even if the concentration of dust is reduced in the dry electrostatic precipitator. A desulfurization unit does not require a cooling/dust removing section and eliminates the need for a wet electrostatic precipitator. The dry electrostatic precipitator includes a gas passage divided into a plurality of parallel passages and dampers operable to close the passages. This arrangement prevents dust from being dispersed as a result of hammering without charge.

3 Claims, 8 Drawing Sheets

METHOD AND SYSTEM FOR HANDLING EXHAUST GAS IN A BOILER

This application is a continuation-in-part of U.S. Ser. No. 07/653,231 filed Feb. 8, 1991 and now abandoned.

BACKGROUND OF THE INVENTION

1. Field of the Invention

The present invention relates to a method and system for removing dust and $SO_x$ from exhaust gas in a coal-fired boiler.

2. Description of the Related Art

FIGS. 4 and 5 are block diagrams of conventional systems for removing dust and $SO_x$ from exhaust gas in a coal-fired boiler.

With reference first to FIG. 4, the system includes a coal-fired boiler 1. The temperature of exhaust gas from the boiler 1 is reduced to 120° to 160° C. in an air preheater 2. Dust is removed from the exhaust gas in a dry electrostatic precipitator 4 until its concentration is reduced to about 100 mg/m$^3$ or slightly higher. Furthermore, in order to save the energy necessary to reheat the gas after desulfurization, heat is recovered in a rotary-reheat type of gas-gas heater 7. Thereafter, the temperature of the exhaust gas is reduced to its saturation temperature in a cooling/dust removing section 6*a* of a wet type of exhaust gas desulfurization unit 6, and the dust is further removed from the exhaust gas. The concentration of $SO_x$ is reduced in a $SO_x$ absorbing section 6*b* provided separately from the cooling/dust removing section 6*a*. Finally, the exhaust gas is reheated in the gas-gas heater 7 and is then discharged through a chimney.

This prior system suffers from the following problems.

(1) As shown in FIG. 6, the temperature of exhaust gas in the electrostatic precipitator is high, and the specific resistance of dust produced by the burning of some types of coal is above $10^{11}$ Ω-cm. When the specific resistance of the dust exceeds $10^{11}$ Ω-cm, reverse ionization occurs in the electrostatic precipitator. This substantially deteriorates the performance of the electrostatic precipitator. For this reason, a large electrostatic precipitator is needed to collect dust at a required rate.

(2) If the concentration of dust at the outlet of the electrostatic precipitator is reduced to 100 mg/m$^3$N or lower, then $SO_3$ remaining in the gas is atomized when the exhaust gas is cooled by the gas-gas heater. $SO_3$ thus atomized is then deposited in the gas-gas heater. This results in the corrosion of members made of the same metal such as carbon steel, stainless steel, etc. It thus becomes necessary to raise the concentration of dust above 100 mg/m$^3$N so as to neutralize $SO_3$ as a countermeasure against the corrosion problem. As a result, the concentration of dust is approximately 20 mg/m$^3$N at the outlet of the desulfurization unit 6. If dust leakage (approximately 10%) takes place in the gas-gas heater 7, then the concentration of dust at the inlet of the chimney is reduced only to 30 mg/m$^3$N at most.

(3) The desulfurization unit uses a lime (limestone, hereinafter)-gypsum method. When it is attempted to recover the by-product gypsum for reuse, if the concentration of dust at the inlet is 100 mg/m$^3$N or more, the dust deteriorates the purity of the gypsum. In order to prevent such a problem and maintain the purity of gypsum at a predetermined level, the desulfurization unit must sometimes be of separation type including a cooling/dust removing section 6*a* and a separate absorbing section 6*b*, particularly in the case where the concentration of $SO_2$ at the inlet is low. This results in an increase in the consumption of space and in the running cost.

FIG. 5 shows a system used when the emission standards for dust to be discharged from the chimney are more severe, for instance, when the concentration of dust at the inlet of the chimney must be reduced to 10 mg/m$^3$N or less. This system includes a leak-free type of gas-gas heater wherein heat exchange is effected through a heating medium. The equipment in this system is made from economical carbon steel. This system is different from the system of FIG. 4 in that a heat recovery section 3*a* is separated from a reheater section 3*b*, and in that a wet electrostatic precipitator 8 is provided downstream of the purifier 6. However, this system suffers from the problems (1) and (3). In order to reduce the concentration of dust from 20 mg/m$^3$N to 10 mg/m$^3$N, a wet electrostatic precipitator is used which takes up more space and increases the running cost of the system.

SUMMARY OF THE INVENTION

Accordingly, it is an object of the present invention to provide a system for handling exhaust gas which is capable of solving the foregoing problems encountered in the prior art based on the following observations by the present inventors.

(1) A dry electrostatic precipitator can maintain its high performance regardless of the type of coal to be used and can be made compact.

(2) Those units located downstream of the dry electrostatic precipitator should not be adversely affected even if the concentration of dust is approximately below 100 mg/m$^3$N at the outlet of the dry electrostatic precipitator.

(3) The cooling/dust removing section and the absorbing section of the desulfurization unit are economical when made integral (combination type), and regardless of the concentration of $SO_2$ at the inlet of the gas-gas heater, even if the dust is mixed into the recovered gypsum, the concentration of dust at the inlet of the desulfurization unit can be reduced to such an extent that the purity of the gypsum is maintained at a predetermined level.

(4) The dust particles at the outlet of the electrostatic precipitator are agglomerated and swollen. The dust removing performance of the desulfurization unit can be enhanced by mainly removing the swollen particles of dust. Removal of particles of dust of a predetermined size can be effected by the desulfurization unit with less energy.

(5) Owing to the enhancement of the dust removing performance of the desulfurization unit as described above, the concentration of dust at the inlet of the chimney can be reduced to 10 mg/m$^3$N or less without the need for a wet electrostatic precipitator.

In order to achieve the foregoing objects, the present invention provides a method and apparatus for handling exhaust gas in a coal-fired boiler, wherein the exhaust gas at the outlet of the preheater of the boiler is cooled to 80° to 110° C. in the heat recovering section of a leak-free type gas-gas heater; then the concentration of dust is reduced to 100 mg/m$^3$N or less at the dry electrostatic precipitator; concurrently, the particles of dust are agglomerated and swollen so as to form coarse particles; and thereafter, the exhaust gas is led to the desulfurization unit where the concentration of $SO_x$ is reduced and, at the same time, the coarse particles of dust are removed under high performance.

In the present invention, as previously described, the heat recovery unit is provided upstream of the dry electrostatic precipitator. Because the temperature of exhaust gas is reduced to 80° to 110° C. at the inlet of the electrostatic precipitator, the specific electric resistivity is lowered and reverse ionization in the electrostatic precipitator is prevented, resulting in an improvement in the performance of the dry electrostatic precipitator. Even if the concentration of dust is reduced to 100 mg/m$^3$N in the electrostatic precipitator, since a heat recovery unit made of carbon steel is not provided downstream of the electrostatic precipitator, there is no corrosion problem due to $SO_3$. Also, since the concentration of dust can be reduced economically to a sufficient level by the dry electrostatic precipitator, an economical combination type of desulfurization until having an integrated cooling/dust removing section and absorbing section can be used regardless of the concentration of $SO_2$ at the inlet thereof, and yet, since the dust removing performance of the desulfurization unit is enhanced, even if the concentration of dust at the inlet of chimney is required to be 10 mg/m$^3$N or less, a wet electrostatic precipitator is not necessary.

Also, in the present invention, by successively closing a plurality of parallel passages in the dry electrostatic precipitator and hammering without charge, a dispersion of dust can be substantially reduced, whereby the performance of the electrostatic precipitator is further improved.

BRIEF DESCRIPTION OF THE DRAWINGS

A better understanding of the present invention may be had by referring to the following description of a preferred embodiment thereof taken in conjunction with the accompanying drawings, in which.

DETAILED DESCRIPTION OF THE PREFERRED EMBODIMENT

Figure 1:
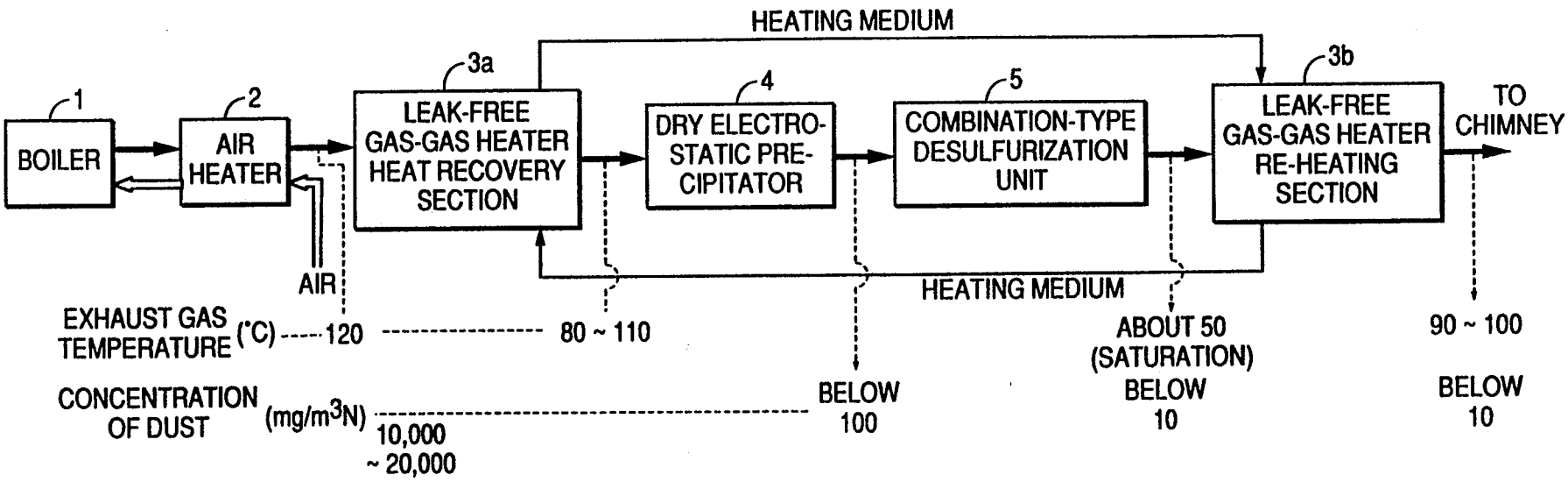
FIG. 1 is a block diagram of one embodiment of a system for handling exhaust gas in a coal-fired boiler according to the present invention.

With reference to FIG. 1, the exhaust gas discharged from a coal-fired boiler 1 includes $SO_x$ and dust. The temperature of the exhaust gas is reduced to 120° to 160° C. while passing through an air preheater 2. A gas-gas heater of the leak-free type includes a heat recovering section 3*a* in which the temperature of the exhaust gas is further reduced to 80° to 110° C. Then concentration of the dust is reduced to 100 mg/m$^3$N or less in a dry electrostatic precipitator 4. Thereafter, more of the dust is removed by a combination type of wet desulfurization unit 5 that employs the lime-gypsum method regardless of the concentration level of $SO_2$ at the inlet thereof. Next, in the state where the concentration of $SO_x$ is reduced to a predetermined level and the exhaust gas has been cooled to its saturation temperature, the exhaust gas is reheated in a reheater section 3*b* of the above-mentioned gas-gas heater, and then the exhaust gas is discharged through the chimney.

The heating medium in the heat recovery section 3*a* of the gas-gas heater absorbs the thermal energy of the exhaust gas. Then the medium is directed to the reheating unit 3*b*, where the medium is cooled by transmitting the thermal energy to the exhaust gas at the outlet of the desulfurization unit, and then the medium is again circulated to the heat recovery section 3*a*.

A denitrification unit or gas fan (suction fan or pressure fan), which may be provided between the boiler 1 and the air preheater 2 and pumps or an auxiliary heater which may be provided in the heating medium line, is not shown in FIG. 1.

In the illustrated embodiment, the heat recovery section 3*a* of the gas-gas heater is located upstream of the dry electrostatic precipitator 4 so as to reduce the temperature of the exhaust gas to 80° to 110° C. as compared to 120° to 160° C. in the conventional systems. In this way, the specific resistance of dust, regardless of the type of coal, is reduced to $10^{11}$ Ω-cm where no reverse ionization occurs. This provides an improved charging condition of the dry electrostatic precipitator and ensures high performance of same. The dry electrostatic precipitator can thus be made compact.

Also, in the illustrated embodiment, the concentration of dust at the inlet of the heat recovery section 3*a* of the gas-gas heater is the same as that at the outlet of the air heater 2 (usually 10 to 20 g/m$^3$N). This concentration is sufficient to remarkably enhance the neutralization of $SO_3$ as compared with the conventional system, thereby completely preventing corrosion caused by $SO_3$. Therefore, the gas-gas heater can be of the leak-free type made from economical carbon steel. It is to be noted that, since the gas-gas heater is of the leak-free type, no leakage of dust takes place at the inlet of the chimney.

Moreover, in the illustrated embodiment, the concentration of dust at the outlet of the dry electrostatic precipitator 4 is sufficiently low, namely 100 mg/m$^3$N or less. Accordingly, even if a combination type desulfurization unit is adopted, regardless of the concentration level of $SO_2$ at the inlet thereof, the purity of the recovered gypsum can be maintained at the predetermined level. Meanwhile, dust can be removed at a high rate because the concentration of dust at the outlet of the desulfurization unit is reduced below a predetermined value by the dry electrostatic precipitator and because mainly the agglomerated and swollen particles of dust are removed. This eliminates the need for a wet electrostatic precipitator.

Reference will next be made to the results of tests carried out by the inventors with a pilot plant to which the present system is applied, as well as to an improvement in the system.

Figure 6:
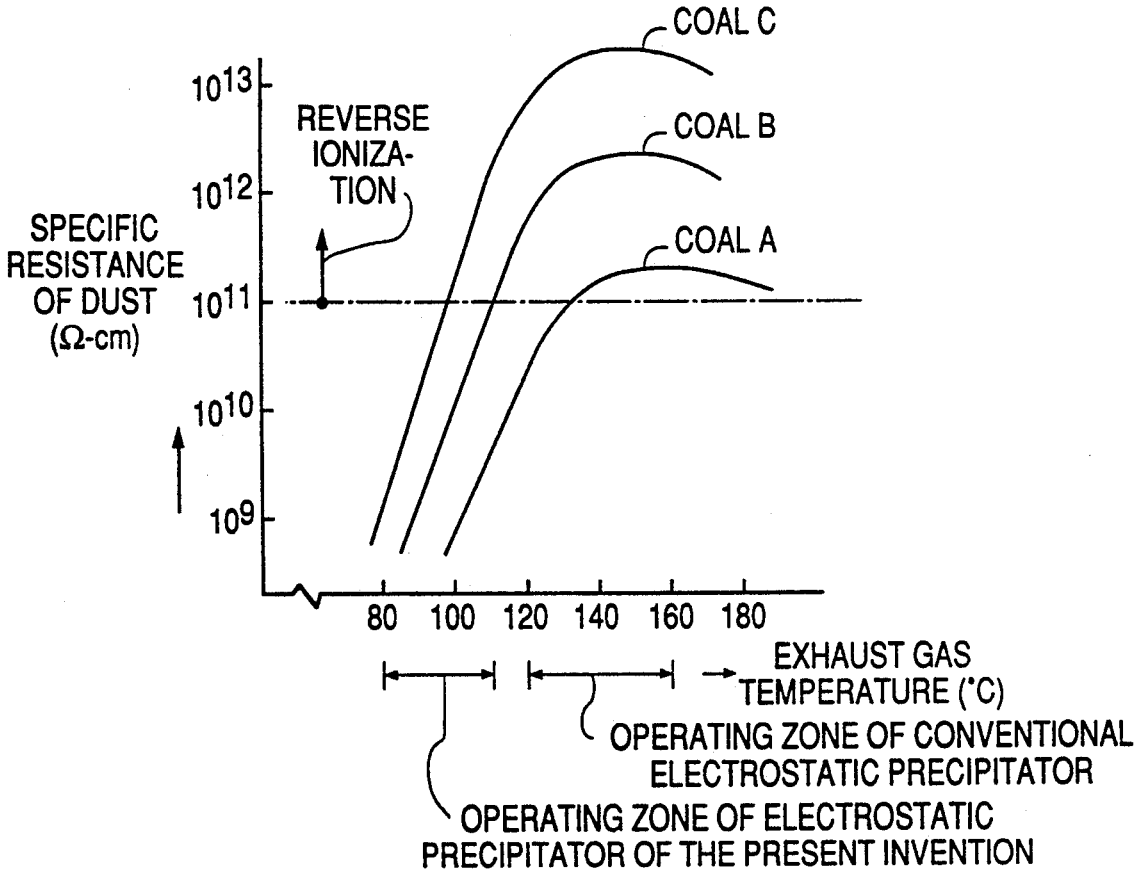
FIG. 6 is a graph showing the temperature of exhaust gas vs. specific resistance of dust.

The specific resistance of dust produced by burning several types of coal was measured. FIG. 6 shows the results based on three typical kinds of coal. The specific resistance of dust has been $10^{11}$ Ω-cm or higher in the prior art systems. In the present invention, the temperature of the exhaust gas is reduced to 90° to 100° C. to ensure that the specific resistance of dust is below $10^{11}$ Ω-cm. As a result, the dry electrostatic precipitator no longer suffers from reverse ionization. This ensures constant charging.

Figure 7:
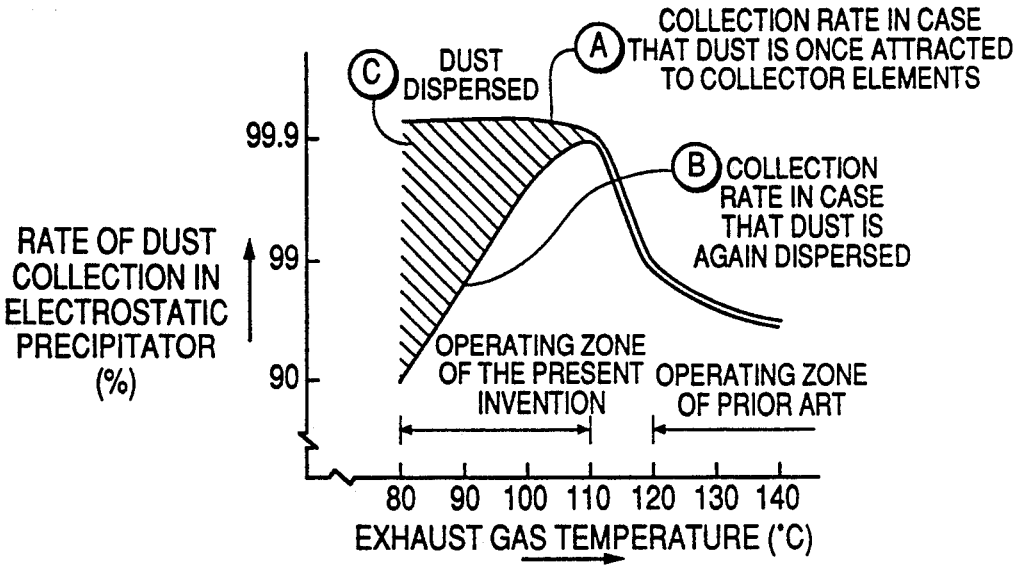
FIG. 7 is a graph showing test results, namely, the relationship between the temperature of exhaust gas and the rate of dust collection in the dry electrostatic precipitator.

FIG. 7 is a graph showing the temperature of exhaust gas vs. the rate of dust collectable by the dry electrostatic precipitator. Dust is effectively attracted to collector electrodes in the electrostatic precipitator as shown by the line A in FIG. 7 since charging conditions have been improved as stated earlier. The exhaust gas is saturated at a temperature of 110° C. or lower. However, the particles of dust are again dispersed due to hammering, etc. This results in a rapid increase in the amount of dust discharged from the electrostatic precipitator. In fact, the rate of dust collection is reduced as shown by the line B in FIG. 7. Dust dispersed from the collector electrodes is shown by a shaded area C in FIG. 7.

Figure 2:
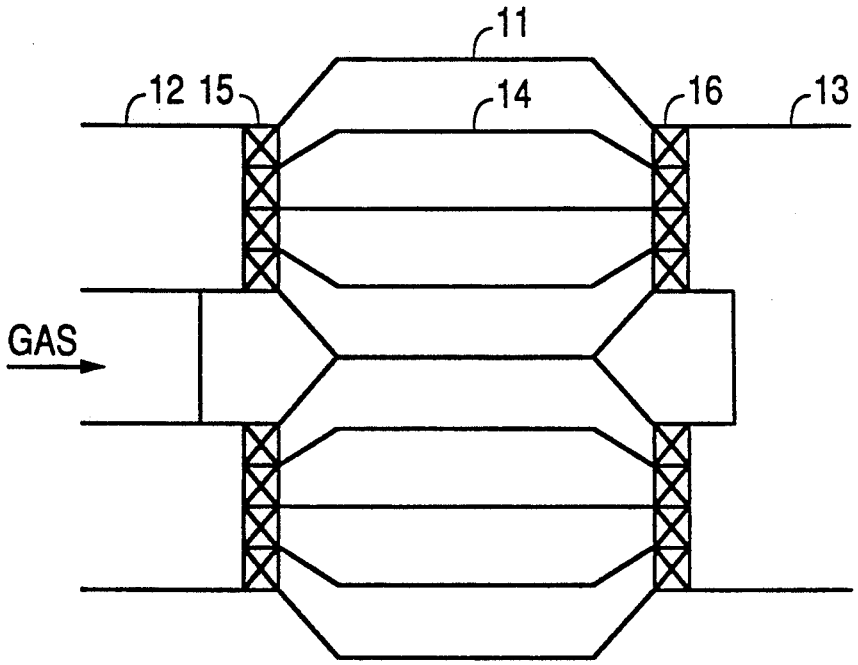
FIG. 2 is a vertical schematic view of a dry electrostatic precipitator included in the system shown in FIG. 1.
Figure 3:
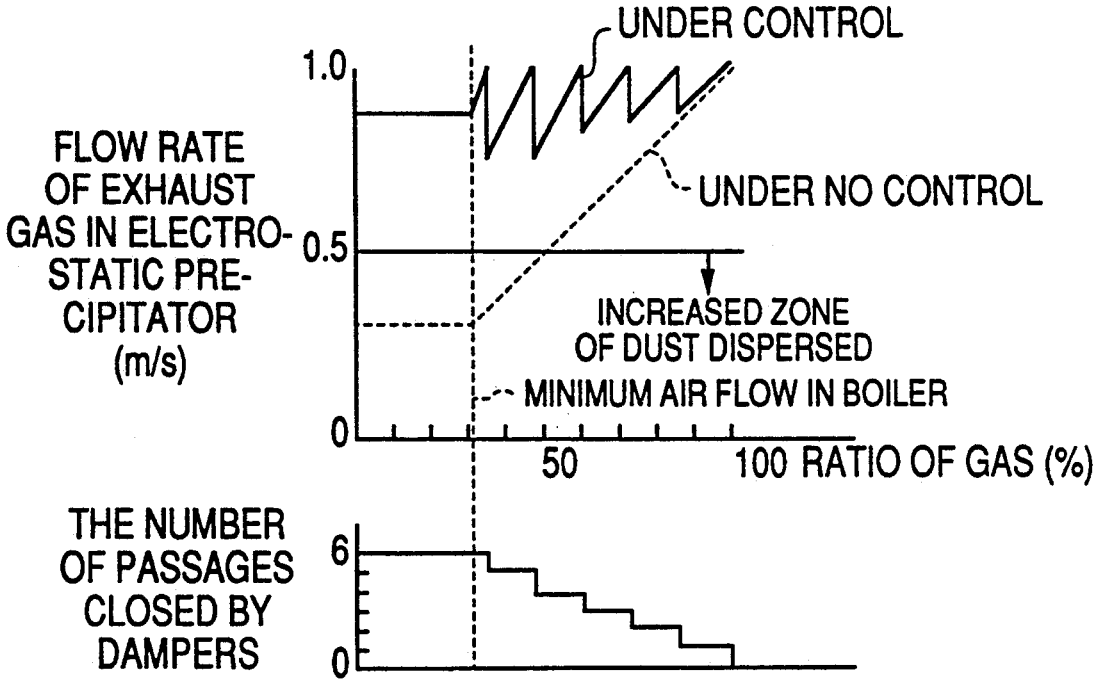
FIG. 3 is a graph showing the flow rate of exhaust gas vs. gas ratio.
Figure 4:
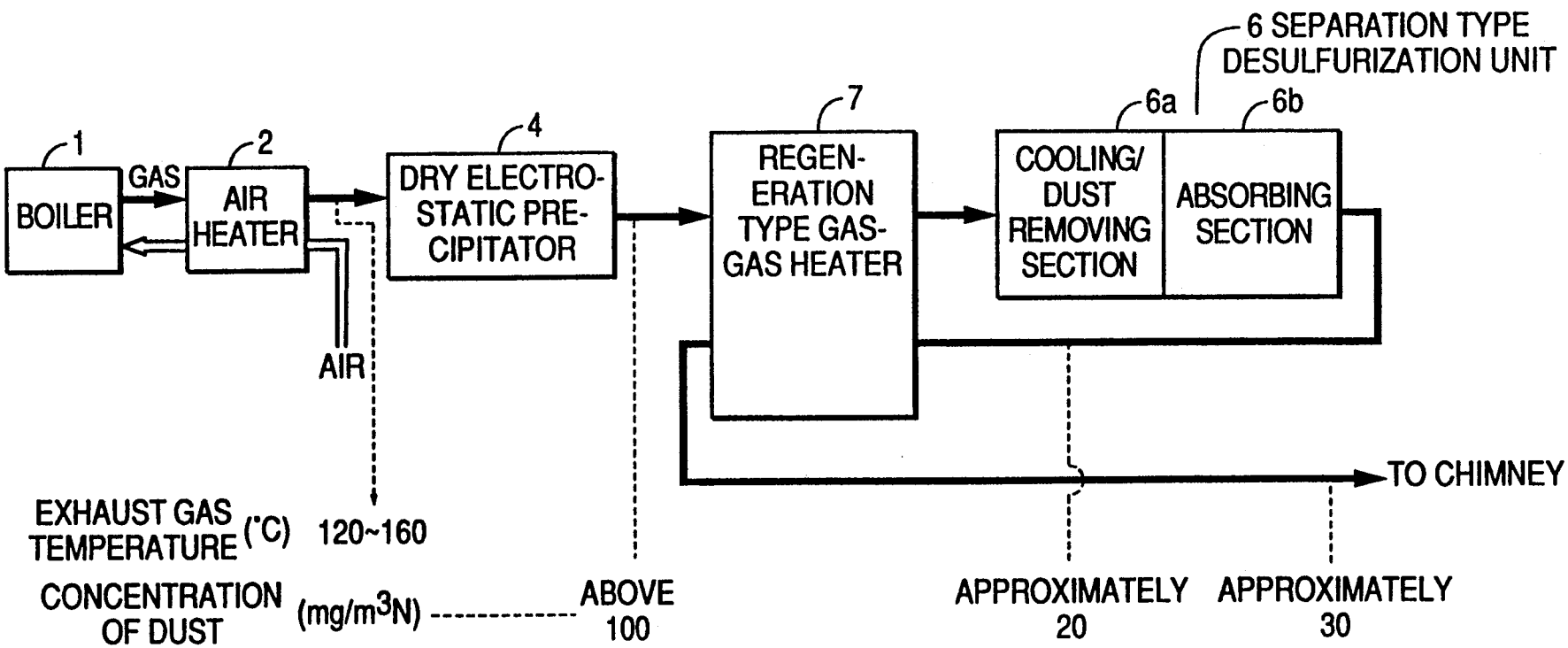
FIG. 4 PRIOR ART
FIGS. 4 and 5 are block diagrams of conventional systems for handling exhaust gas in a coal-fired boiler.
Figure 5:
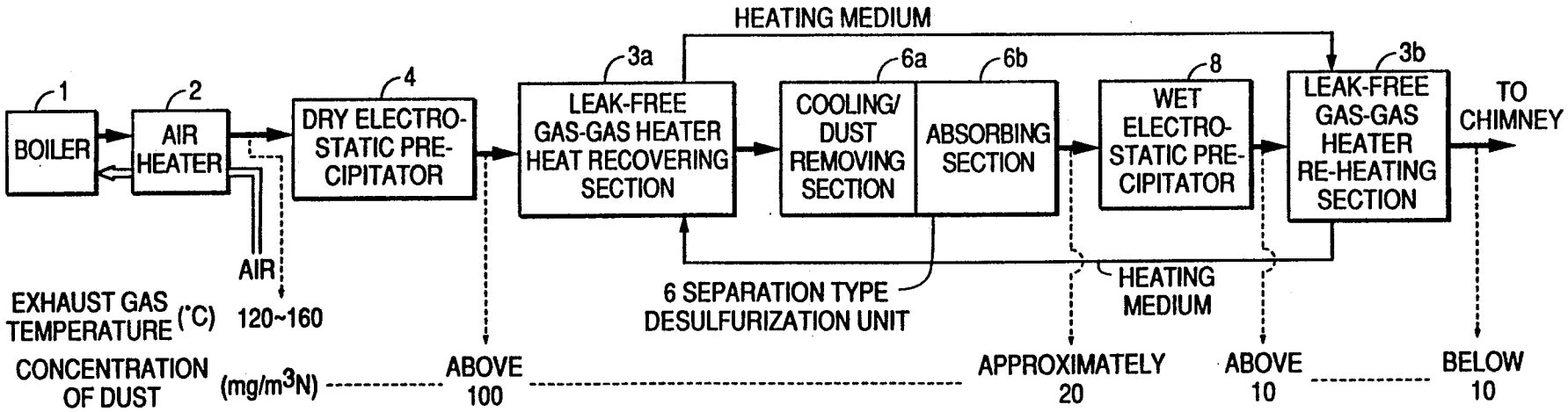
FIG. 5 PRIOR ART

Various attempts have been made to prevent dust from being dispersed from the collector electrodes. As a result, it has been found that dispersion of dust can be substantially reduced and the dust can be highly effectively collected by providing dampers in the electrostatic precipitator as shown in FIG. 2 and effecting hammering without charge. In FIG. 2, reference numeral 11 designates a main body of the dry electrostatic precipitator, 12 an inlet duct, 13 an outlet duct, and 14 partitions by which a gas passage within the electrostatic precipitator main body 11 is divided into a plurality of parallel passages (eight passages in FIG. 2). Reference numerals 15 and 16 designate inlet and outlet dampers provided for the respective passages mentioned above.

Figure 8:
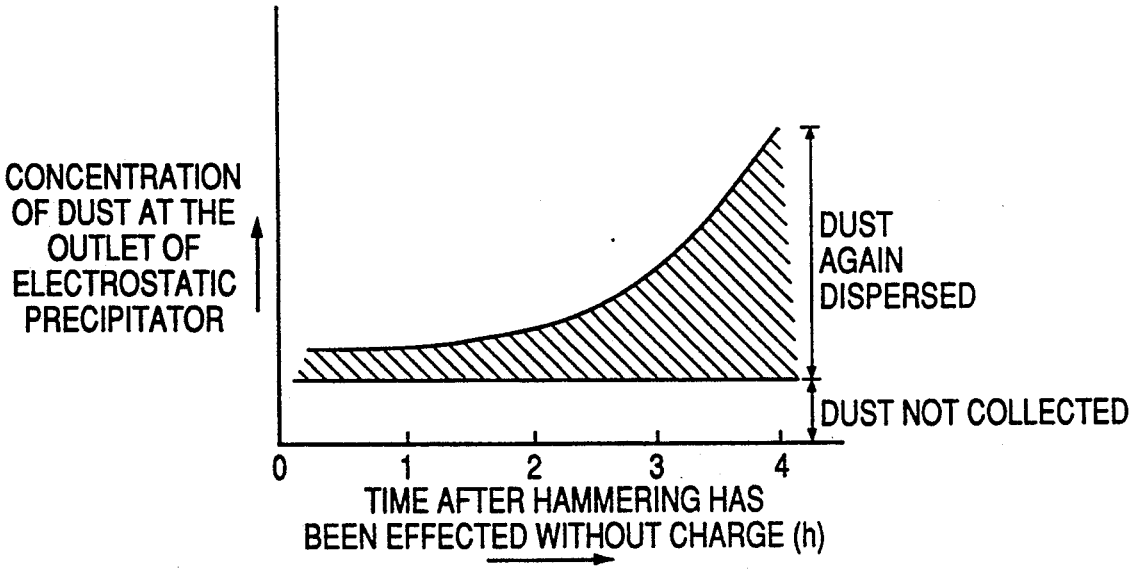
FIG. 8 is a graph showing time after hammering has been effected without charge vs. the concentration of dust at the outlet of the dry electrostatic precipitator.

FIG. 8 shows the concentration of dust at the outlet of the electrostatic precipitator vs. time after hammering has been effected without charge. It has been found that the amount of dust dispersed is kept low for a period of two to three hours after hammering has been effected. With the arrangement shown in FIG. 2, hammering is carried out for about fifteen minutes without charge while the eight gas passages are subsequently closed by the respective dampers. In this way, the hammering can be repeated every two hours so as to prevent an increase in the dispersion of dust.

Figure 9:
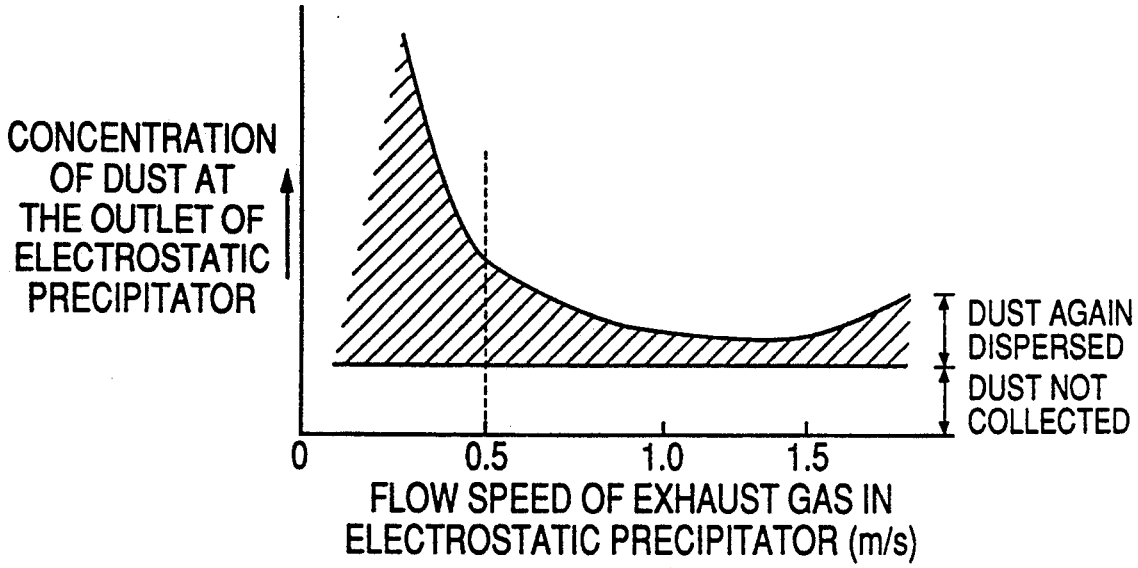
FIG. 9 is a graph showing the flow speed of exhaust gas within the electrostatic precipitator vs. the concentration of dust at the outlet of the dry electrostatic precipitator.

FIG. 9 shows the flow speed of exhaust gas vs. the concentration of dust or the amount of dust dispersed as a result of hammering. As shown in FIG. 9, it is clear that the dust is rapidly and substantially dispersed when the flow speed of the exhaust gas is below 0.5 m/s. This means that the electrostatic precipitator is less effective when the boiler is operated under low load. To this end, the number of the passages closed by the dampers in the electrostatic precipitator is changed in response to the flow of the exhaust gas so as to control the speed of the exhaust gas flowing therethrough.

Figure 10:
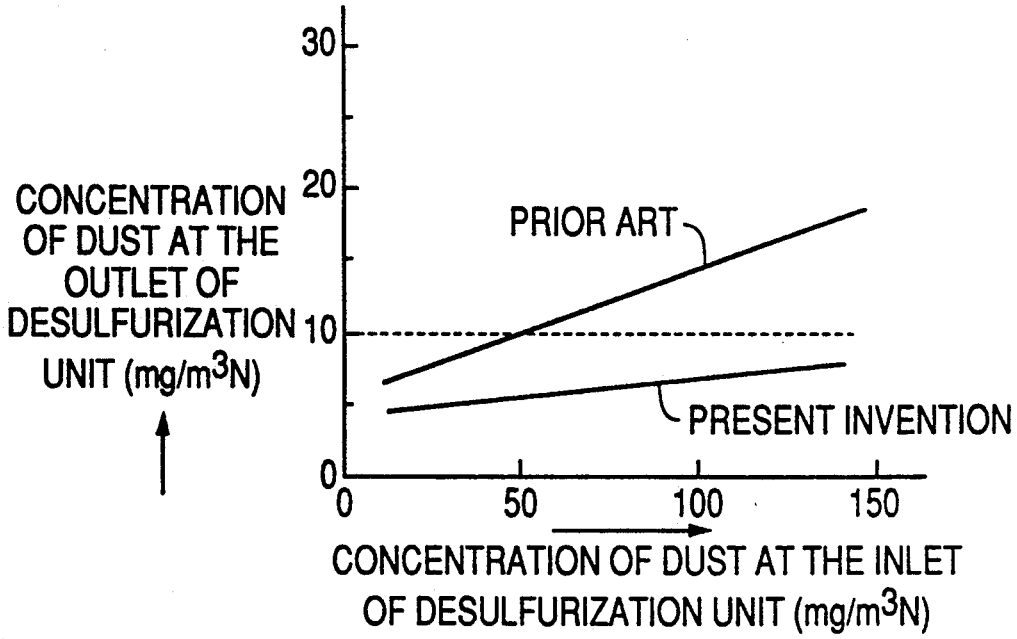
FIG. 10 is a graph showing the dust collection characteristics of the desulfurization in the present system and the prior art system, respectively.
Figure 11:
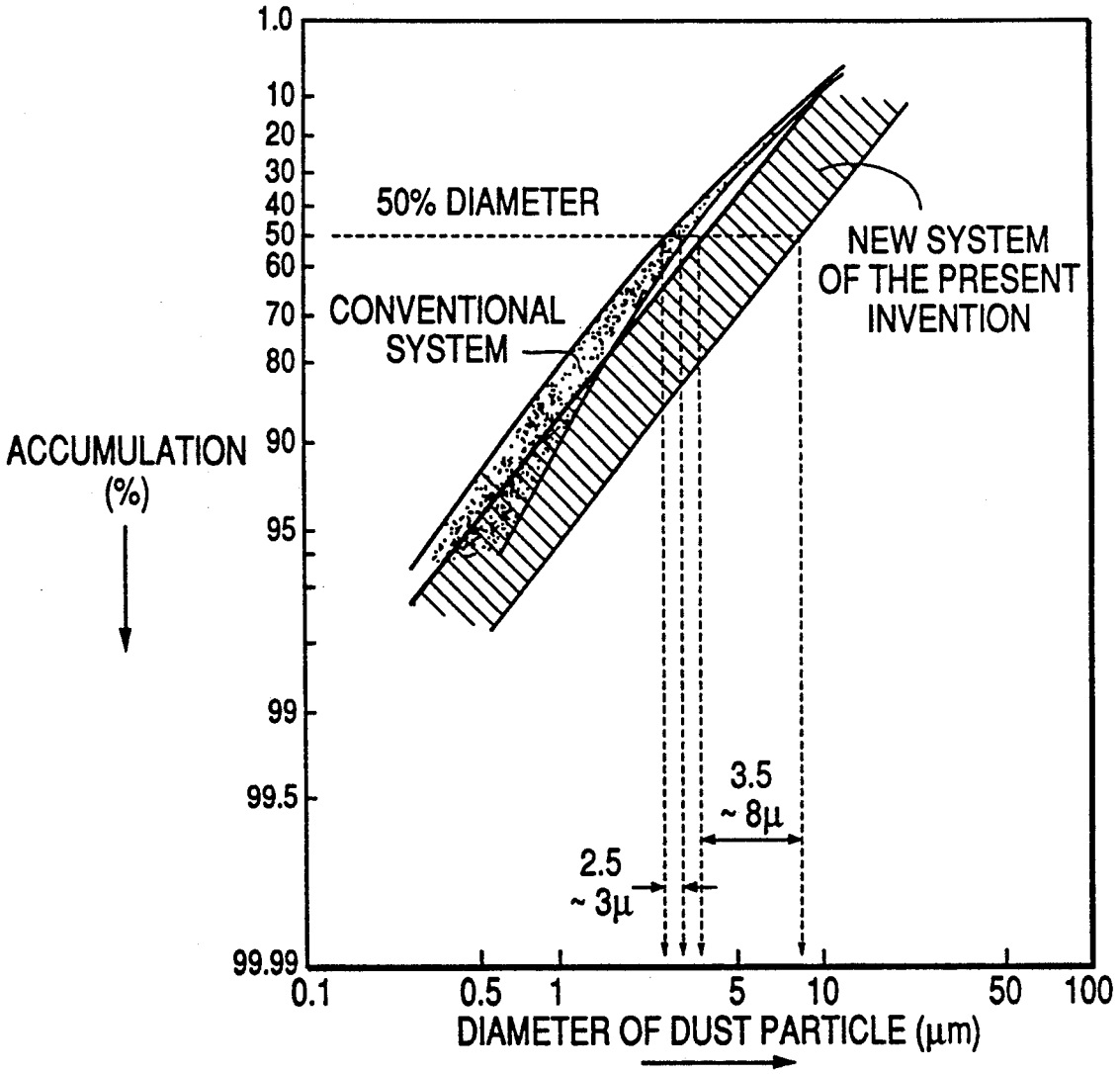
FIG. 11 is a graph showing the diameter of the dust particles vs. the accumulation of the dust particles of a specific size.

FIG. 10 shows dust collection characteristics of the desulfurization unit. It has been found that the desulfurization unit of this embodiment provides a substantial improvement in dust collection over the prior art desulfurization unit. This is due to the fact that, in the illustrated embodiment, the proportion of the agglomerated and swollen particles of dust is relatively high in the outlet dust of the dry electrostatic precipitator. Namely, whereas in the prior art system, the average diameter (hereinafter referred to as the "50% diameter") of the dust particles is 2.5 to 3 μm, in the system of the present invention, the dust particles having been mutually adhered and agglomerated are coarse particles having a 50% diameter of 3.5 to 8 μm as shown in FIG. 11. This characteristic results in the advantage of the system of the present invention of facilitating an effective and efficient removal of dust without the need for a wet electrostatic precipitator.

In the present invention, a method other than the lime-gypsum method may be used. In order to further reduce the concentration of dust, a wet electrostatic precipitator of a small capacity may be provided downstream of the desulfurization unit.

The present invention provides a method and system for handling exhaust gas in a coal-fired boiler which consumes less space and is economical to manufacture compared to the prior art. Advantages of the present invention include the following:

(1) A compact dry electrostatic precipitator can be used for various types of coal having a wide variety of characteristics.

(2) Regardless of the concentration level of $SO_2$, even if a compact combination type of desulfurization unit is adopted, the purity of the recovered gypsum can be maintained at high level.

(3) The concentration of dust at the outlet of the desulfurization unit can be reduced to 10 mg/m$^3$N or less without the need for a wet electrostatic precipitator.

While the present invention has been described above in connection with preferred embodiments thereof, it is intended that all matter contained in the specification be interpreted as illustrative of and not as a limitation on the scope of the present invention as defined by the appended claims.

What is claimed is:

1. A system for handling exhaust gas in a coal-fired boiler, said system comprising: an air preheater of the boiler, a leak free type of a gas-gas heater having a heat recovery section and a reheating section through which heating medium is circulated, a dry electrostatic precipitator, and a desulfurization unit all disposed in a gas flue of the boiler, said air preheater being disposed at an upstream location in the gas flue so as to reduce the temperature of the exhaust gas to a predetermined temperature, the heat recovery section of said gas-gas heater being disposed downstream of said air preheater in the gas flue so as to further reduce the temperature of the exhaust gas, said dry electrostatic precipitator being disposed downstream of said heat recovery section in the gas flue so as to reduce the concentration of dust in the exhaust gas to a predetermined level, said desulfurization unit being disposed downstream of said dry electrostatic precipitator in the gas flue so as to reduce the concentration of $SO_x$ in the exhaust gas and further reduce the temperature thereof and the concentration of dust therein, and the reheating section of said gas-gas heater being disposed downstream of said desulfurization unit in the gas flue so as to reheat the exhaust gas that has been desulfurized in said desulfurization unit.

2. A system for handling exhaust gas in a coal-fired boiler as claimed in claim 1, wherein said dry electrostatic precipitator defines a plurality of gas passages therethrough communicating with both the heat recovery section of said gas-gas heater and said desulfurization unit, and said dry electrostatic precipitator includes a plurality of dampers disposed in said gas passages, said dampers being adjustable to inhibit the flow of exhaust gas through said passages to various degrees.

3. A method for handling exhaust gas in a coal-fired boiler, said method comprising the steps of:

cooling the exhaust gas from the coal-fired boiler to a temperature of between 80° and 110° C. by directing the exhaust gas through an air preheater of the boiler and a heat recovery section of a leak free type of gas-gas heater;

subsequently reducing the concentration of dust in the exhaust gas to 100 $mg/m^3N$ by directing the gas through a dry electrostatic precipitator;

subsequently reducing $SO_x$ in the exhaust gas by passing the exhaust gas through a desulfurization unit; and subsequently heating the exhaust gas by passing the exhaust gas through a reheating section of the gas-gas heater and circulating heating medium between the reheating and heat recovery sections of the gas-gas heater.

* * * * *